US005464289A

United States Patent [19]

Beaudry

[11] Patent Number: 5,464,289

[45] Date of Patent: Nov. 7, 1995

[54] ELECTROGRAPHIC LABEL PRINTING SYSTEM

[76] Inventor: Wallace J. Beaudry, Hunter Rd., R.R. 1, Elkhart Lake, Wis. 53020

[21] Appl. No.: 296,191

[22] Filed: Aug. 24, 1994

[51] Int. Cl.[6] ..... B41J 5/30

[52] U.S. Cl. ..... 400/62; 400/120.01; 400/613; 400/621; 101/486; 101/490; 101/DIG. 46; 101/219; 101/227; 101/481; 156/277; 156/387

[58] Field of Search ..... 400/613, 61, 62, 400/65, 67, 68, 76, 77, 120.01, 62.1, 708, 120.18; 101/486, 490, DIG. 43, DIG. 46, 92, 93.11, 481, 219, 227; 156/277, 384, 387

[56] References Cited

U.S. PATENT DOCUMENTS

| | | | |
|---|---|---|---|
| 3,032,245 | 5/1962 | George et al. | 101/219 |
| 3,592,091 | 7/1971 | Ottavan | 101/227 |
| 4,004,509 | 1/1977 | Moss | 101/248 |
| 4,066,015 | 1/1978 | Polko | 101/219 |
| 4,082,039 | 4/1978 | Schutt et al. | 101/DIG. 46 |
| 4,094,727 | 6/1978 | Collins | 101/227 |
| 4,366,753 | 1/1983 | Glanz et al. | 101/227 |
| 4,447,148 | 5/1984 | Hatzis | 101/DIG. 43 |
| 4,569,584 | 2/1986 | St. John et al. | 346/157 |
| 4,827,315 | 5/1989 | Wolfberg et al. | 346/160 |
| 5,239,924 | 8/1993 | Wallmann et al. | 101/481 |

*Primary Examiner*—Eugene H. Eickholt
*Attorney, Agent, or Firm*—Wheeler & Kromholz

[57] ABSTRACT

An electrographic label system is disclosed whereby flexographic and electronic printing are combined in a modular design to produce multi-color labels. Label stock is unwound from a roll and passes over an automatic shut off roller that shuts down the entire printing process and stops the flow of label stock when it runs out so that a new roll of stock can be sliced to the old roll and rethreading the system is not necessary. A back slitter having a roller cutter cuts the desired height of the label leaving a feed strip between the label and opposite edge. The label stock is fed into a flexographic printer having a drum which imprints a first image, cuts the label to the correct length, and imprints a register mark on the feed strip. The label stock material is next fed into an electronic printer interfaced with a computer or programmable logic controller which imprints a second image upon each label. Upon exiting the electronic printer, the label stock is wound into a roll by a takeup spool or automatically dispensed onto the product or package.

11 Claims, 4 Drawing Sheets

ELECTROGRAPHIC LABEL PRINTING SYSTEM

BACKGROUND OF THE INVENTION

Labels affixed to products for identification purposes are printed in various ways. One of the most common and inexpensive methods of printing labels employs a flexographic printer. A flexographic printing plate is manufactured having the opposite image of the label. The plate is attached to the drum of the flexographic printer. With each revolution of the drum, ink is applied to the plate and the plate then makes contact with the label material and imprints the label image thereon. When this type of printing process is employed, all of the label information, including product name, trademarks, brand name, tag lines, descriptions, ingredients, weight, volume, fanciful design elements, etc., must be printed simultaneously. If any of this information must be changed or modified, at least a portion of the flexographic printing plate must be remanufactured. If the label changes are substantial, a new printing plate must be manufactured.

Alternatively, labels can be printed using one of many types of electronic printers. These printers are typically connected to computers or programmable logic controllers (PLCs) and include laser printers, ink jet printers, thermal/thermal transfer printers, spray printers, dot matrix printers, and the like. The information to be printed upon each label is entered and stored within the computer or PLC which in turn sends the information to the printer. This method of printing labels is typically inefficient. More time is required to print each label. The more or fancier the information, the more time consuming the process. The quality of labels printed entirely by electronic printers is often inferior. While flexographic printers have the capability of custom die cutting label stock, labels printed electronically must be printed on pre-die cut label stock. Misalignment of the stock in the electronic printer can cause numerous problems.

Neither of the above label printing processes can easily print two-color labels.

The present invention combines flexographic label printing with electronic label printing in order to produce one or two-color labels having a variety of information elements including information that is used regularly on a group or type of label (permanent copy) and information that is changed from one label batch to the next (variable copy). It is an object of this invention to provide a label printing system meeting this criteria. It is a further object to provide such a system that is contained as one integral unit. It is further an object to provide such a system that is easy to use and produces high quality labels. These and other objects of the invention will become apparent in the following descriptions.

SUMMARY OF THE INVENTION

The invention comprises an electrographic printing system whereby a label having a two-part image is produced. The system includes two printers, a flexographic printer and an electronic printer.

Label stock is unwound from a roll and passes over an automatic shutoff roller and splicer. The automatic shutoff roller shuts down the entire printing process and stops the flow of label stock when it runs out so that a new roll of label stock can be spliced using the splicer to the old roll and rethreading the system is not necessary. Next, a back slitter cuts through only the label portion of the label stock. The backing or liner that serves as a carries to which the label stock is adhered to is not cut. The back slitter comprises a roller-cutter. The narrow margin portion of the label stock cut by the back slitter serves as a feed strip used to advance the label stock through the flexographic printer.

The first image is printed flexographically by a flexographic printer. This portion of the label typically will have a permanent nature. It may comprise the manufacturer's name and address, a fanciful border, a brand name, a trademark, or a tag line. It is the type of information that will not change from specific product to specific product. The flexographic printer also laterally but cuts or die cuts each individual label on the label stock. The thin band or feed strip formed by the back slitter remains along one edge of the label stock material. This feed strip serves two purposes. First as indicated above, it is utilized to feed the label stock through the flexographic printer. It adds to the strength of the label stock material after the labels have been die cut and only the label backing or liner remains in a contiguous state. Second, a small register mark comprising a dot or similar geometric shape is flexographically printed on the feed strip. This register mark is located at a predetermined position with respect to the flexographically printed image. When the label subsequently enters the electronic printer where additional information is thermally printed on the label, the electronic printer reads the location of the register mark. Once the position of the register mark has been determined, the electronic printer knows where to print the second part or portion of the label image. This second printed portion is information that must be changed or modified from one batch of labels to the next. It is likely to include a product name, product size, product weight, universal product code, product price, or other specialized information.

The electronic printer is preferably a thermal/thermal transfer printer which is controlled by a computer or programmable logic controller (PLC). The operator or system can easily change or modify the information that is electronically printed on each label. Once the information has been entered into the computer or PLC and stored, it can be easily recalled and does not have to be reentered.

Finally, the printing system includes an optional label dispenser which dispenses each label individually by removing the label from the label backing and applying the label to the particular product or package to which it corresponds. The label backing is wound onto a takeup spool that can be disposed of or recycled when full. The speed of the label dispenser is correlated with the speed of the product such that proper label-product alignment is achieved. A clutch assembly controls the takeup spool on which the label backing is wound. If the optional label dispenser is not employed, the fully printed labels are simply wound onto the takeup spool into a roll similar to that of the blank label stock material.

DETAILED DESCRIPTION

Figure 2:
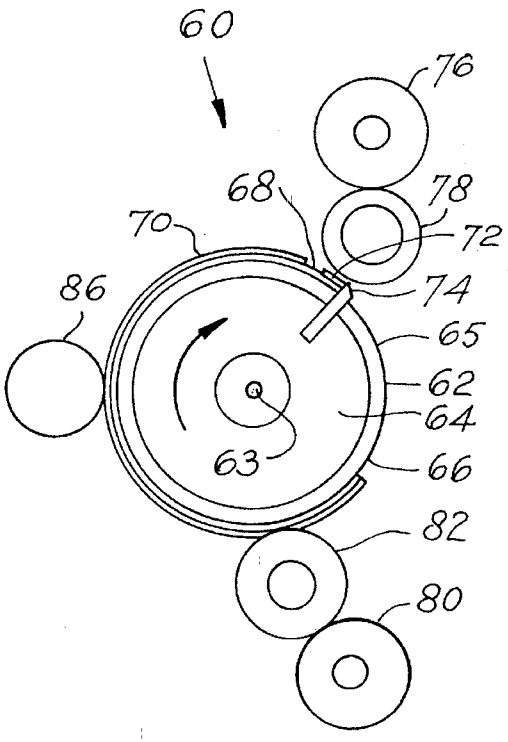
FIG. 2 is an end view of the components of the flexographic printer.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The invention 10 comprises an electrographic label printing system having a base 15, a label stock dispenser 20, a back slitter 50, a flexographic printer 60, an electronic printer 120, and a label takeup spool 160. Blank label stock 22 on a roll 30 is initially withdrawn from dispenser 20, and back slit by back slitter 50. The back slit label stock 22 enters flexographic printer 60 where the flexographic label image or permanent copy 100 is printed, a register mark 108 is printed, and the individual labels 110 are laterally cut at 102. The label stock 22 next enters an electronic printer 120 where the electronic label image or variable copy 140 is printed. Finally, the label stock 22 having fully printed labels 110 thereon is wound around label takeup spool 160.

Figure 1:
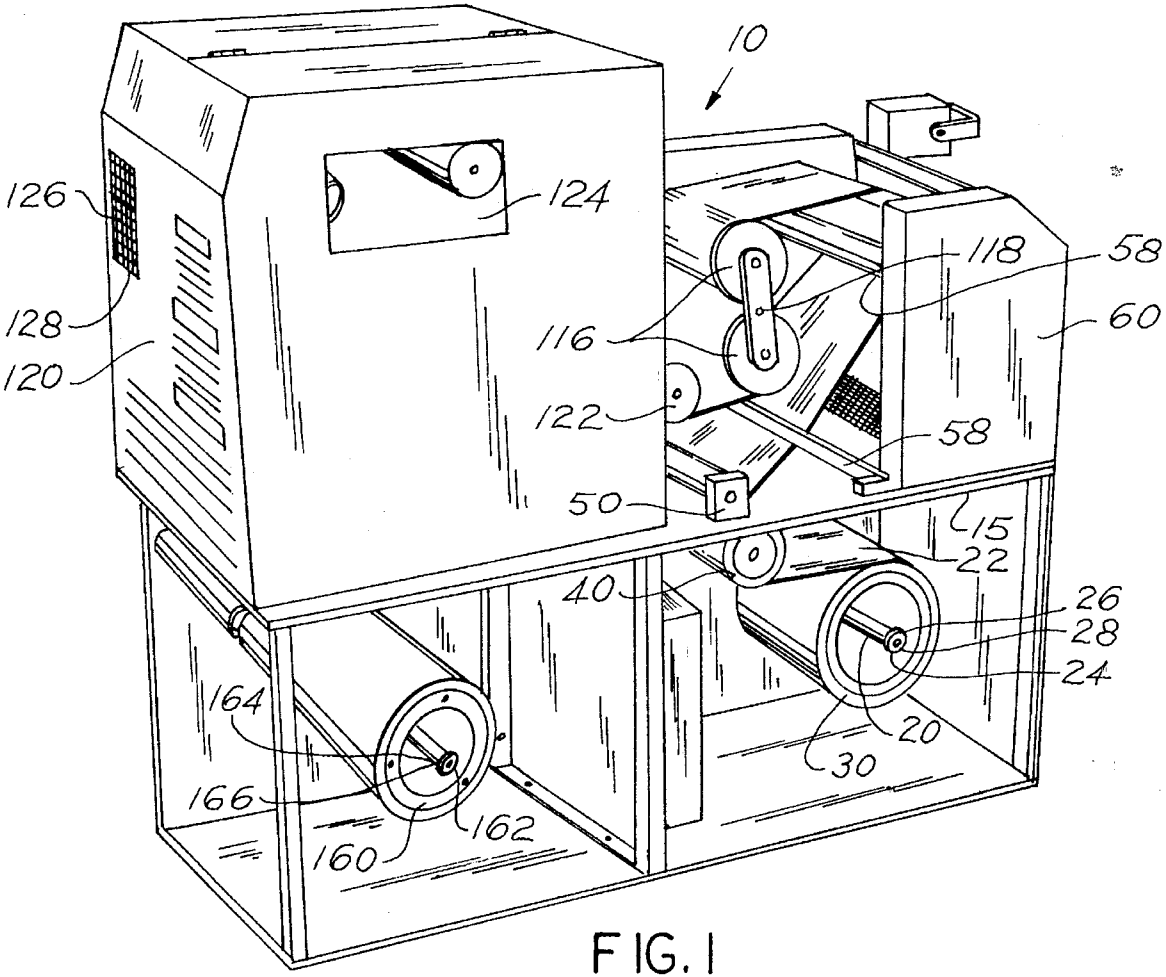
FIG. 1 is a perspective view of the electrographic label printing system.

As shown in FIG. 1, blank label stock 22 on a roll 30 is rotatably mounted onto label stock dispenser 20 which includes a clutch assembly 24. The clutch assembly 24 comprises a spring 26 and a knurled nut 28. The spring 26 is biased between the roll 30 and the nut 28 such that it exerts a constant force upon roll 30. Due to this force, label stock 22 is not permitted to freely roll off of roll 30 and some pulling force is required for the label stock 22 to be dispensed.

The label stock 22 next engages auto shutoff roller 40. Threaded properly, the label stock 22 supports roller 40 in an upwardly biased position. When label stock roll 30 runs out, label stock 22 can no longer support auto shutoff roller 40 in the upwardly biased position. When roller 40 falls to its lower position, the entire system 10 shuts down. At this point, a new roll 30 of label stock 22 can be loaded onto label stock dispenser 20 and spliced to the end of the previous roll 30. An optional splicer may be attached adjacent to shut off roller 40 to facilitate the splicing of two rolls 30 of label stock 22. By stopping the system before the end of the previous roll 30 is advanced through the system 10 the need to rethread the entire system 10 is eliminated. Once the new roll 30 is loaded and spliced, the new roll 30 is manually turned backward so that auto shutoff roller 40 is biased upward again into its operating position. The clutch assembly 24, discussed supra, applies an adequate amount of friction against the roll 30 so that when label stock 22 is properly threaded, auto shutoff roller 40 is maintained in the upward biased position.

Figure 3:
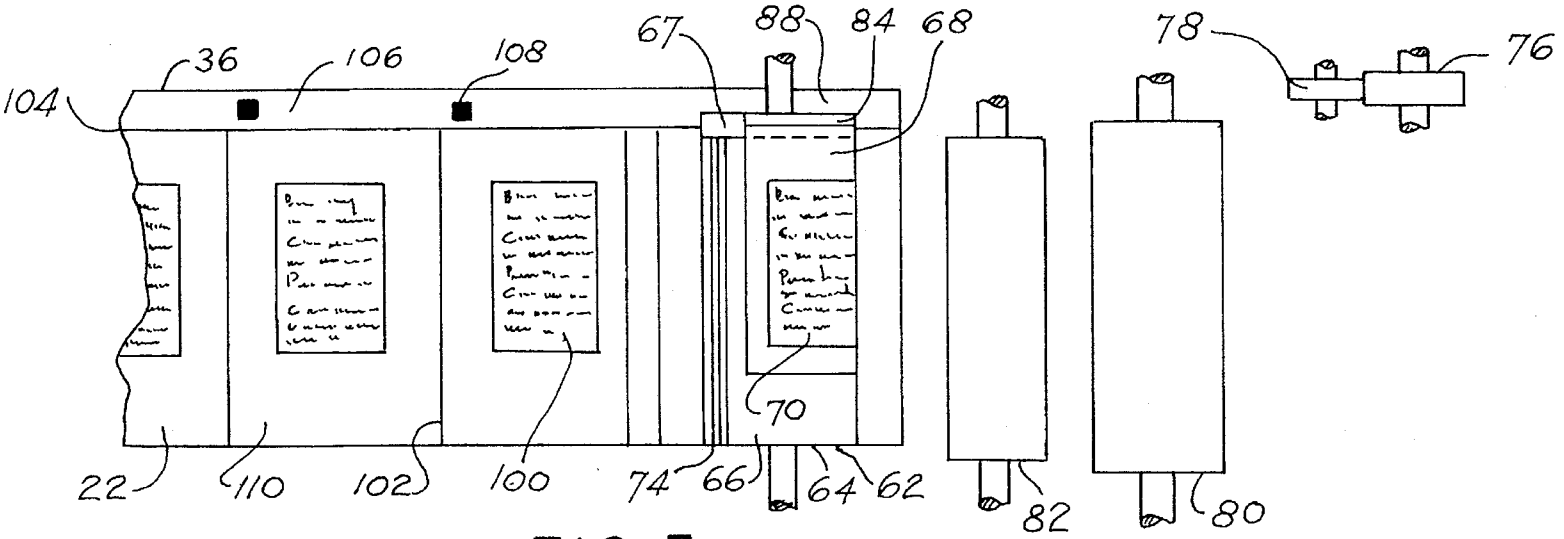
FIG. 3 is an exploded top view of the flexographic printer and includes label stock material.
Figure 7:
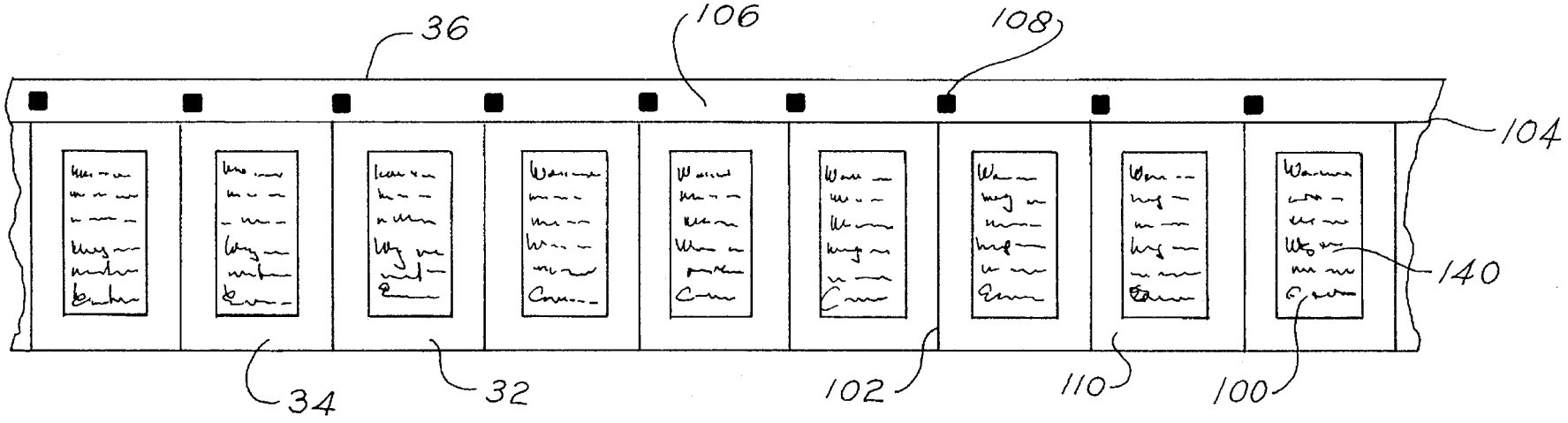
FIG. 7 is a top view of label stock material having permanent copy and variable copy images imprinted thereon.

Label stock 22 next proceeds into back slitter 50 where the label portion 32 of label stock 22 is slit at 104 parallel to label stock edge 36. The resulting label stock material 22 is best shown in FIGS. 3 and 7. The narrow strip portion or margin between the slit 104 and edge 36 forms a feed strip 106. The remaining portion 110 is the portion of the label stock 22 where the actual labels will be printed.

Label stock 22 consists of a top portion or label portion 32 and a bottom or backing portion 34. The back slitter 50 only cuts through the top portion 32 leaving the backing or liner 34 in tact. Thus the label stock 22 remains an integral strip of material even after back slitting.

Label stock 22 next enters flexographic printer 60 at the flexographic printer input 58. The mechanism of the flexographic printer is shown in FIG. 2. The printer 60 includes a print cylinder 62 having a metal core 64. A layer of cushion material 66 encases the exterior drum surface 65 of the print cylinder 62 except for metal edge portion 67. The print cylinder 62 rotates on a central axis 63.

Figure 5:
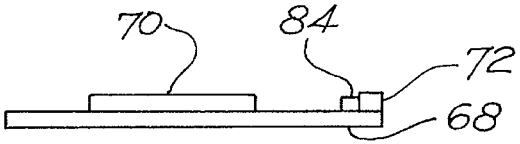
FIG. 5 is a side view of the flexographic printing plate.
Figure 4:
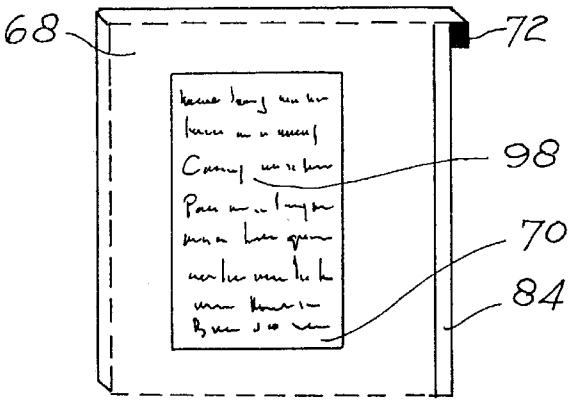
FIG. 4 is a top view of the flexographic printing plate.

Removably fixed, typically by means of an adhesive, to the cushion material layer 66 and metal edge portion 67 of print cylinder 62 is a flexographic printing plate 68. The plate 68 prints the flexographic label image or permanent copy 100 on portion 110 of the label stock 22. The cushion material 66 allows for compression of the portion of the printing plate 68 attached to the cushion material 66 when it is brought against the label stock 22. The plate 68 is best shown in FIGS. 4 and 5. Attached to the top surface of plate 68 are two raised portions 70 an 72. The larger raised portion 70 contains a reversed image 98 of the permanent copy 100 to be imprinted flexographically on label portion 110. Smaller portion 72 prints a register mark 108 on the feed strip 106 of the label stock 22.

Referring to FIGS. 2 and 3, the ink supplying apparatus can be seen. The ink color used to print the flexographic image or permanent copy 100 must be different from the color used to print the register mark 108. Furthermore, the ink used to print the register mark 108 must be optically readable.

A foam roller 80 is impregnated with the desired color of ink for permanent copy 100. Roller 80 tangentially contacts engraved surface roller 82. A precisely metered amount of ink is transferred from foam roller 80 to engraved surface roller 82 at this line of contact. Engraved surface roller 82 in turn tangentially contacts raised portion 70 of flexographic printing plate 68 during a portion of the revolution of print cylinder 62. Engraved surface roller 82 deposits an exact of amount of ink on the raised portion 70 of the plate 68. The amount is sufficient to imprint one image 100 on the label stock 22. Similarly, foam roller 76 which is also impregnated with an opaque colored ink, is in tangential contact with engraved surface microroller 78. Smaller raised portion 72 contacts microroller 78 whereby a precisely metered amount of ink is transferred to print a register mark 108 on feed strip 106. After inking, portions 701 and 72 of flexographic printing plate 68 come into contact with label stock 22. An anvil shaft 86, as shown in FIG. 2 is provided to firmly press label stock 22 against portions 70 and 72 so that a high quality image 100 and a register mark 108 are produced.

An additional structure is also attached to print cylinder 62. A straight cutting die 74 cuts or laterally perforates the top layer 32 of the label stock 22. The cutting operation similarly occurs when anvil shaft 86 presses label stock 22 firmly against cutting die 74.

Attached to flexographic printing plate 68 as shown in FIG. 4 is a raised feed strip portion 84. The feed strip portion 84 is positioned exactly above metal edge portion 67 of print cylinder 62 when flexographic printing plate 68 is attached to print cylinder 62. This long rectangular strip 84 feeds the label stock 22 through the flexographic printer 60. The label stock 22 is captured between feed strip portion 84 and anvil shaft 86. Because feed strip portion 84 rests upon metal edge portion 67 and not on cushion material 66, there is less resilience between feed strip portion 84 and anvil shaft 86 allowing the label stock 22 to be pulled into flexographic printer 60.

As print cylinder 62 rotates on axis 63, label stock 22 is drawn around cylinder 62 and ultimately is pressed into contact with raised portions 70 and 72 by anvil shaft 86. At this line of contact, the image 100 from large portion 70 and the register mark 108 from smaller portion 72 is imprinted upon label stock 22. The feed strip portion 84 in conjunction with larger area 70 determines the length of the label or where the label is cut by cutting die 74. Because the label stock 22 is only fed through the flexographic printer 60 when the label stock is captured between anvil shaft 86 and raised feed portion 84, the length of raised feed portion 84, which is typically slightly longer than larger portion 70, determines the length of the label by controlling how much label stock 22 is fed through flexographic printer 60 before cutting die 74 comes into alignment with anvil shaft 86.

Label stock 22, now cut laterally and having an image 100 and register mark 108 imprinted, is fed through dancer rollers 116. Dancer rollers 116 pivot on dancer roller axis 118 and take up any extra slack in label stock 22.

Label stock 22 next enters electronic printer 120 at electronic printer input 122. A thermal/thermal transfer printer is used in the preferred embodiment. The electronic printer 120 includes feed rollers which grip label stock 22 including liner 34 and draw label stock 22 into electronic printer 120. The electronic printer 120 also includes an electronic eye 124 located above the area where feed strip 106 enters electronic printer 120. The electronic eye 124 reads each register mark 108 and then sends a signal to the printing head of electronic printer 120. Once electronic printer 120 knows the location of register mark 108, electronic printer 120 knows where to begin printing the variable copy or electronically printed portion 140 on the label stock 22. Using this system, it is not necessary to time or adjust the label stock 22 entering the electronic printer 120 so that the electronically printed portion 140 of the label 110 is correctly positioned on each printed label 110.

Electronic printer 120 is interfaced with a computer or PLC 126 having some type of data input means 128. The information (variable copy) to be electronically printed on each label 110 is entered at the data input means 128. Again, the variable information or copy 140 printed on each individual label 110 is the type of information that must be frequently changed such as exact product description, package contents, package weight, expiration date, etc.

Finally, label stock 22 as shown in FIG. 1 exits electronic printer 120 and is wound around takeup spool 160. Takeup spool 160 contains a clutch assembly 162 similar to clutch assembly 24 on label stock dispensed 20. Clutch assembly 162 includes a spring 164 and a knurled nut 166.

Figure 6:
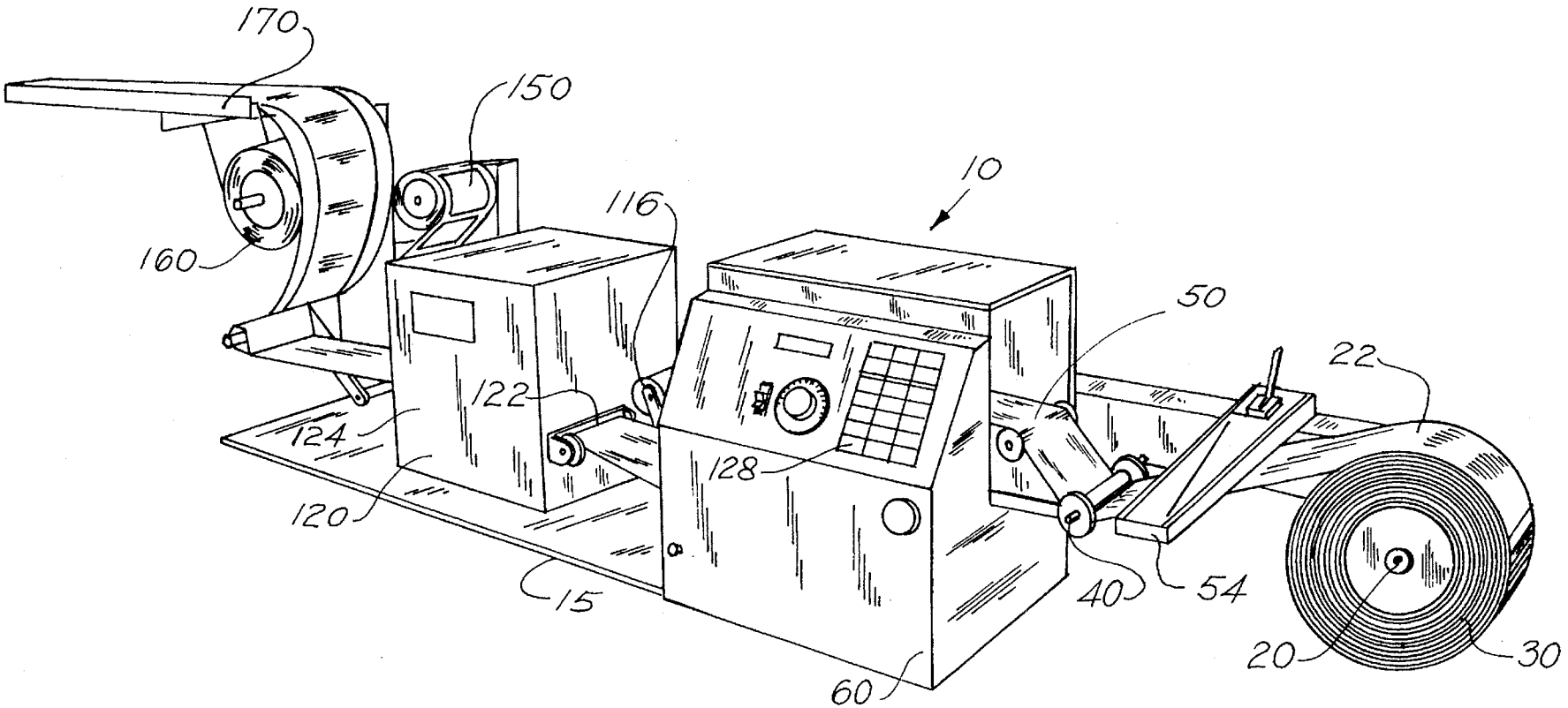
FIG. 6 is a perspective view of an alternative embodiment of the electrographic label printing system.

An alternative embodiment of the present invention 10 is shown in FIG. 6. Label stock 22 is dispensed from a roll 30 rotatably mounted to dispenser 20. The label stock 22 next engages shut off roller 40 which again must be maintained in an upwardly biased position for the system 10 to operate. When label stock roll 30 runs out, a new roll 30 is spliced to the old roll 30 by utilizing splicer 54. The label stock 22 is next back slit or trimed at back slitter 50. While shut off roller 40 and back slitter 50 are shown to be offset in FIG. 6, back slitter 50 could be moved outwardly so that it is directly over shut off roller 40.

Label stock 22 is next fed into flexographic printer 60 where the permanent or flexographic portion 100 of the label and register mark 108 are imprinted and the label stock 22 is laterally cut. The label stock 22 exits flexographic printer 60 and is threaded through dancer roller 116 before it enters electronic printer 120 at 122 where electronic eye 124 locates the register mark 108 and the variable copy 140 is added to each label 110. Upon exiting electronic printer 120, a stripper 150 strips away the excess portions of the top layer 32 of stock label material 22. The fully printed labels 110, still attached to backing material 34, can be either rewound on takeup spool 160 or fed through an automatic individual label dispenser 170 where each label 110 is individually removed from backing material 34 and brought into alignment with the product or package to which the label 110 is to be attached.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An apparatus for printing labels, the apparatus comprising:

a base;

a label stock dispenser mounted to the base;

a label stock slitter having a rotatably attached roller cutter mounted to the base adjacent the label stock dispenser;

a flexographic printer mounted to the base adjacent the label stock slitter;

the flexographic printer having a rotatably mounted printing drum;

a first printing plate for printing permanent copy and a second printing plate for printing a register mark removably mounted to the drum;

an electronic printer mounted to the base adjacent the flexographic printer;

the electronic printer having an electronic eye for locating the register mark;

a label takeup spool mounted to the base adjacent to the electronic printer.

2. The apparatus of claim 1 wherein the label stock dispenser includes a clutch assembly.

3. The apparatus of claim 1 wherein the flexographic printer printing drum further includes a feeding strip portion attached to a circumferential portion of the drum and a cutting die attached laterally to the drum.

4. The apparatus of claim 3 wherein the flexographic printer printing drum includes a circumferential metal edge, the feeding strip portion being attached to the metal edge.

5. The apparatus of claim 1 further including a shutoff roller mounted to the base between the label stock dispenser and the flexographic printer.

6. The apparatus of claim 1 further including a pair of dancer rollers pivotally mounted to the base between the flexographic printer and the electronic printer.

7. The apparatus of claim 1 further including a label stock splicer mounted to the base between the label stock dispenser and the label stock slitter.

8. The apparatus of claim 1 wherein the takeup spool includes a clutch assembly.

9. The apparatus of claim 1 further including a label stock stripper mounted to the base adjacent the electronic printer.

10. The apparatus of claim 8 further including an automatic individual label dispenser mounted to the base adjacent the label stock stripper.

11. An apparatus for printing labels, the apparatus comprising:

a base;

a label stock dispenser having a clutch assembly mounted to the base;

a label stock slitter having a rotatably attached roller cutter mounted to the base adjacent the label stock dispenser;

a flexographic printer mounted to the base adjacent the label stock slitter;

the flexographic printer having a printing drum including a metal edge;

the printing drum having a first printing plate attached to the drum for printing permanent copy, a second printing plate attached to the drum for printing a register mark, a cutting die laterally attached to the drum and a feeding strip circumferentially attached to the metal edge of the drum;

a pair of dancer rollers pivotally mounted to the base adjacent the flexographic printer;

an electronic printer mounted to the base adjacent the pair of dancer rollers;

the electronic printer having an electronic eye for locating the register mark and a printing head for printing variable copy;

a label takeup spool mounted to the base adjacent the electronic printer.

* * * * *